United States Patent [19]

Lange

[11] 4,200,142

[45] Apr. 29, 1980

[54] RISER NECK FOR MOLDING CASTINGS

[76] Inventor: Richard L. Lange, 7635 Staley Rd., New Carlisle, Ohio 45344

[21] Appl. No.: 929,698

[22] Filed: Jul. 31, 1978

[51] Int. Cl.[2] ..... B22C 9/02

[52] U.S. Cl. ..... 164/359; 249/105

[58] Field of Search ..... 164/359, 360, 410; 249/105, 109

[56] References Cited

U.S. PATENT DOCUMENTS

| | | | |
|---|---|---|---|
| 694,315 | 2/1902 | Carroll | 164/360 |
| 969,015 | 8/1910 | Washburn | 164/359 |
| 3,467,172 | 9/1969 | Clem | 164/359 X |
| 3,815,665 | 6/1974 | Baur | 164/359 |

FOREIGN PATENT DOCUMENTS

| | | | |
|---|---|---|---|
| 1271320 | 6/1968 | Fed. Rep. of Germany | 164/360 |

*Primary Examiner*—Robert D. Baldwin

*Attorney, Agent, or Firm*—W. Britton Moore

[57] ABSTRACT

A no-fume riser neck for use in molding the connecting neck between the riser cavity and general mold cavity in the production of metal castings. The neck is generally cup-shaped and preformed of sheet metal with a closed and substantially sealed upper end and an open flared and grooved lower end which is positioned open-end down on the face of a foundry pattern so that the sealed upper end is gas tight and separates the open riser cavity from the mold cavity and prevents extraneous material from entering and contaminating the mold cavity, and also prevents the unrestricted escape of objectionable gases and fumes from the mold cavity to the environment during the pouring cycle.

7 Claims, 7 Drawing Figures

RISER NECK FOR MOLDING CASTINGS

This invention relates to a no-fume riser neck for use in molding the connecting neck between the riser cavity and general mold cavity in the production of metal castings, particularly those benefiting by an integrally cast-on riser or feeder head.

While it is, of course, common foundry practice in molding castings to embed a pattern in sand to produce a mold cavity after its withdrawal and into which metal is introduced through a pouring basin having an in-gate channel communicating with the main pattern cavity, such molds are also furnished with a riser opening to accommodate molten metal after the mold is filled and from which the molten metal will drain back into the mold to compensate for shrinkage occurring as the metal solidifies. Upon cooling and removal of the casting from the mold, metal in the riser will remain attached to the main casting and is suitably removed therefrom and is ground off flush therewith. However, it is customary for such risers being open to the mold cavity through which objectionable gases, smoke and fumes escape from the mold cavity into the environment, such as occurs in the devices of U.S. patent to Washburn Nos. 900,970—10/13/08 and 969,015—8/30/10, as well as other representative U.S. Pat. No. to Haggenjos 793,067,—6/27/05, and Nichols 1,175,555—3/14/16. These prior art structures allow for the entry of extraneous contaminating dirt, sand and other matter into the mold cavity, and the escape of excessive amounts of gases from mold binders, washes, or the burning of expendable pattern material through the riser openings.

The principal object of the present invention is to provide a preformed, cup-shaped, no-fume riser neck for use in molding the connecting neck between the riser cavity and the general mold cavity in the production of metal castings, embodying a closed and substantially sealed upper end and a depending grooved and flared side wall for positioning on a foundry pattern and through which gases cannot escape or extraneous contaminating material enter the mold cavity.

Another object is the provision of a preformed cup-shaped, no-fume riser neck having a flat, closed, and sealed upper end and a depending annular, grooved, and flared side wall to provide an open lower end for positioning on and adherence in the sand mold below the riser and forming a groove in the formed casting to facilitate severence of the riser therefrom.

Still another object is to provide a preformed no-fume riser neck which will seal the riser opening so that passage of gases and extraneous material therethrough is prevented, with the gases diffusing out through the permeable sand of the mold or other suitable vents.

A further object is the provision of a preformed no-fume riser neck interposed between the riser and main mold cavity and which will remain intact throughout the pour until it is finally ruptured by the molten metal of the near-full casting cavity.

A still further object is to provide an effective metal seal so as to insure the production of cleaner castings, with greater safety and better environmental conditions during the pouring cycle of the mold.

These and other objects and advantages will be apparent as the specification is considered with the accompanying drawings, wherein FIG. 1 is a cross section through a rammed mold, showing an expendable pattern or a mold cavity formed by a pattern together with riser, and no-fume riser neck interposed therebetween;

Figure 1:
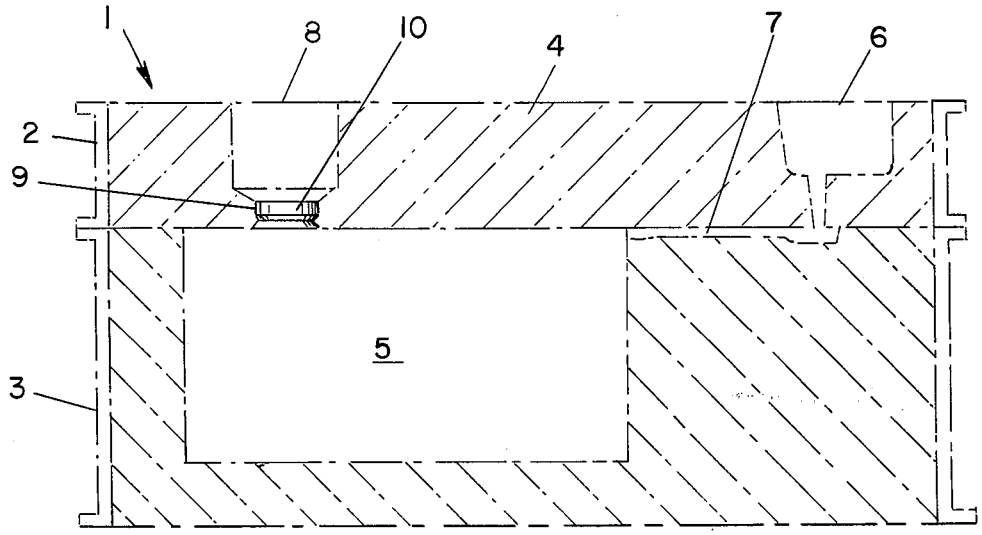
Figure 2:
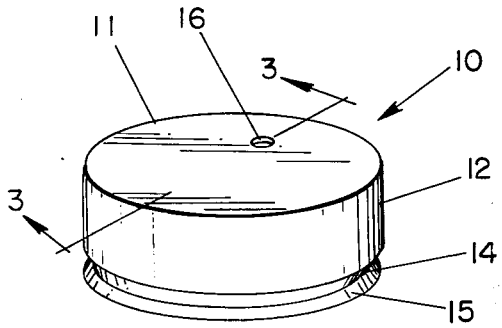
FIG. 2 is a perspective view of the preferred embodiment of the no-fume riser neck in its operative position.
Figure 3:
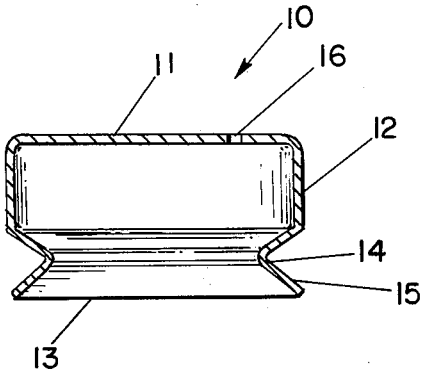
FIG. 3 is a section on the line 3—3 of FIG. 2.

Referring more particularly to the drawings, wherein similar reference characters designate like parts throughout the several views, numeral 1 indicates a two-part mold or flask of any suitable construction which is adapted to be set up on and supported by the usual flat mold board, not shown. The upper and lower, generally rectangular, sections 2 and 3 contain molding sand 4 packed around an expendable pattern or a main mold cavity 5 shaped by a conventional pattern, not shown, arranged therein to give form to the body being cast.

A pouring basin or recess 6 is formed within the sand 4 in the upper section 2, usually adjacent one end thereof, and an in-gate channel 7 extends transversely from the lower end of basin 6 and communicates with the main mold cavity 5, in the conventional manner. A vertical, generally annular, riser passage 8 formed in the sand at an appropriate place in upper section 2, which passage is reduced at its lower end, as at 9, to provide an annular opening into the main mold cavity 5.

Arranged and snugly fitting within reduced riser passage 9 is a preformed cylindrical riser neck 10 of some suitable material, such as, sheet metal, having a flat, closed and substantially sealed upper end 11 with an annular vertical side wall 12 formed on and depending therefrom, which is open at its lower end, as at 13. Formed in side wall 12, adjacent lower open end 13, is a V-shaped annular groove 14 providing a flared lower end 15, for a purpose presently to be described. The riser neck 10 is disposed in riser passage 9 and the flared end 15 is embedded in the molding sand 5 which is received in groove 14 thereof, as best shown in FIG. 1. Thus, the riser neck will be interposed between the riser 8 and the main mold cavity, or the riser 8 and an expendable pattern if such was used, and the flat, closed, upper end wall 11 will block and seal the riser passage and effectively prevent the passage therethrough of gases from the mold and/or the pattern, which will tend to diffuse out through the permeable molding sand. A small vent opening 16 may be formed in end wall 10, and will serve as a weep opening in the riser neck to permit the venting of the air in the preform itself therethrough and into the riser. However, this opening will be of such a reduced diameter that no significant flow of mold gas will occur therethrough.

Figure 4:
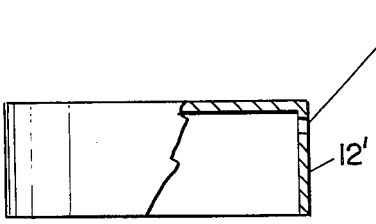
FIG. 4 is another embodiment of riser neck.
Figure 5:
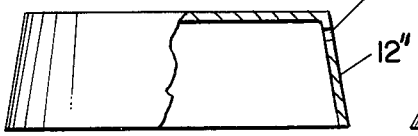
FIG. 5 is another embodiment of riser neck.
Figure 6:
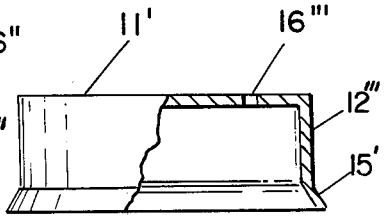
FIG. 6 is still another embodiment of riser neck.
Figure 7:
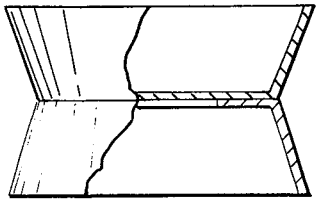
FIG. 7 is still another embodiment of riser neck with two parts suitably joined together.

Other embodiments of riser necks are shown in FIGS. 4 to 7, with that of FIG. 4 including an annular and vertical ungrooved side wall 12' having a weep opening 16' adjacent the upper end thereof. In FIG. 5, the depending annular side wall 12'' angles downwardly and outwardly, and weep hole 16'' is similarly formed adjacent the upper end thereof. On the other hand, in that of FIG. 6, the side wall 12''' is vertical and is flared outwardly, as at 15', and the weep opening 16''' is formed in the flat upper end 11'. FIG. 7 shows a two-part assembly with the parts joined mechanically but not being gas-tight. It will, of course, be noted that in each of the preferred form and embodiments, the riser neck is of inverted cup-shape with an open lower end.

During the casting process, molten metal is poured into basin 6 and passes through in-gate passage 7 and flows into the main mold cavity volatilizing the expendable pattern if such was used. Excess metal will be forced from the mold cavity upwardly into the riser neck 10, melting it away, and filling the riser thereabove. Upon cooling and removal of the casting from the mold, the riser neck preform 10 will have been completely assimulated into and become a part of the metal of the riser. Thus, the riser, along with the in-gate metal passage, will form integral appendages on the casting, which will require removal by grinding and the like, in an obvious manner. In this connection, the annular V-shaped groove 14 in the riser neck will have produced a groove in the casting to facilitate the removal of the riser from the main casting.

While a preferred embodiment and several modified forms of no-fume riser neck have been shown and described, it is to be understood that various changes and improvements may be made therein, without departing from the scope and spirit of the appended claims.

What is claimed is:

1. In combination with a foundry mold having a main mold cavity formed by a removable pattern or holding an expendable pattern, a pouring basin and passage leading therefrom to the mold cavity, and an open riser passage above and having a reduced annular lower end communicating with the mold cavity, of a generally cylindrical inverted thin-walled cup shaped substantially gas impervious riser neck means interposed and arranged in said reduced lower end between said riser passage and mold cavity, said riser neck means comprising a flat closed upper end, an annular side wall depending from said upper end and having an open lower end, whereby said closed upper end functions as a substantially gas tight seal preventing the passage of mold gases therethrough and separates the open riser from the mold cavity.

2. In the combination according to claim 1, wherein said annular side wall is grooved and flared adjacent its lower end.

3. In the combination according to claim 2, wherein a weep opening is formed in said flat closed upper end.

4. In the combination according to claim 1, wherein said annular side wall is vertical, and a weep opening is formed therein.

5. In the combination according to claim 1, wherein said annular side wall slopes downwardly and outwardly, and said weep opening is formed therein.

6. In the combination according to claim 1, wherein said annular side wall is vertical and is flared outwardly at its open lower end.

7. In the combination according to claim 1, wherein said annular side wall is grooved through the device of joining two components, only the upper of which is gas-tight.

* * * * *